US005800452A

United States Patent [19]

Hastings

[11] Patent Number: 5,800,452

[45] Date of Patent: Sep. 1, 1998

[54] BODY PIERCING INSTRUMENT HOLDER

[76] Inventor: John A. Hastings, 31 Main St., Bass River, Mass. 02664

[21] Appl. No.: 810,076

[22] Filed: Mar. 4, 1997

[51] Int. Cl.[6] ..... A61B 17/00

[52] U.S. Cl. ..... 606/188

[58] Field of Search ..... 606/188, 205–211, 606/119, 120, 142, 157; 81/424.5, 426.5; 294/99.2

[56] References Cited

U.S. PATENT DOCUMENTS

| | | | |
|---|---|---|---|
| 3,270,745 | 9/1966 | Wood | 606/207 |
| 3,326,216 | 6/1967 | Wood | 606/147 |
| 4,164,224 | 8/1979 | Hastings . | |
| 4,191,190 | 3/1980 | Hastings . | |
| 5,127,915 | 7/1992 | Mattson | 606/120 |

*Primary Examiner*—William Lewis
*Attorney, Agent, or Firm*—Wolf, Greenfield & Sacks, P.C.

[57] ABSTRACT

The holder is designed for use with piercing instruments such as that disclosed in U.S. Pat. No. 4,164,224. The holder consists of a pair of jaws connected by a flexible bight. Each jaw has a recess at its free end to receive a portion of the piercing instrument. One jaw has a number of opposing protrusions disposed on an inner surface of the jaw. In use, the piercing instrument is inserted between the jaws of the holder. The piercing instrument is thereby securely retained in all three dimensions, so that it cannot be accidentally dislodged from the holder prior to use, such as during packaging, sterilizing or shipping. The holder and instrument are aligned with, for example, an earlobe between the pin and locknut carried by the piercing instrument. As the jaws of the holder are squeezed together, the piercing pin and a receiving locknut are moved toward one another. Further pressure on the legs of the holder releases the piercing pin, suddenly projecting it through the earlobe into engagement with the locknut. As pressure is relaxed, the resilience of the holder's bight moves the jaws apart, leaving the pin and nut secured to the earlobe and the piercing instrument free of the holder for separation from the pin and locknut.

5 Claims, 4 Drawing Sheets

BODY PIERCING INSTRUMENT HOLDER

BACKGROUND OF THE INVENTION

1. Scope of the Invention

This invention is directed to a holder for use with a body piercing instrument.

2. Discussion of the Related Art

This invention is designed to facilitate the use of disposable piercing instruments such as the instrument disclosed in U.S. Pat. No. 4,164,224, which patent is commonly owned with the present application and is incorporated by reference in its entirety. Heretofore, disposable body piercing instruments of the type described in this patent are occasionally improperly used when a closing force is not applied in alignment with the plunger. Furthermore, it may be difficult to maintain a secure grip on the piercing instrument, particularly for individuals with large hands or limited dexterity.

U.S. Pat. No. 4,191,190, which patent is also commonly owned with the present application and incorporated by reference in its entirety, discloses a holder for the piercing instrument. While the design of that holder enables the user to more easily and effectively use the piercing instrument, the holder is not designed to prevent the piercing instrument from swiveling relative to the holder. Such swiveling is problematic when the user is attempting to align the piercing instrument with the body part to be pierced. To keep the piercing instrument in alignment with the holder, the user may have to hold the holder and the piercing instrument in order to keep them in coplanar alignment.

Furthermore, because the piercing instrument is not firmly secured to the holder, the assembly is more difficult to package for shipment or sale.

It is, therefore, desirable to provide a holder which is capable of preventing the piercing instrument from swiveling out of coplanar alignment with the holder when the piercing instrument is installed in the holder.

It is also an object of the present invention to provide a combination holder and piercing instrument which may be assembled together in a stable combination prior to use, but when used, the piercing instrument is easily removed from the holder.

SUMMARY OF THE INVENTION

The preferred embodiment of the present invention is a holder for securely engaging a body piercing instrument. The body piercing instrument of U.S. Pat. No. 4,164,224 comprises a body portion, a plunger adapted to engage a head of a body piercing pin and a locknut support adapted to receive a pointed end of the pin after it has been projected through a body part. The holder in which the body piercing instrument is secured comprises a U-shaped member having first and second legs extending from a resilient bight of the member. A first recess disposed in the first leg engages the plunger of the piercing instrument and a second recess disposed in the second leg engages the locknut support. Means are also provided for engaging and securing the instrument in fixed relation to the legs of the holder. The engaging means comprises at least one protrusion, arranged on an inside surface of the second leg and extending toward the first leg. The engaging means further comprises a pair of opposing protrusions arranged on the second leg such that when the plunger is received by the first recess and the locknut support is received by the second recess, the body portion of the piercing instrument is positioned between the opposing protrusions.

According to another embodiment of the present invention, a holder for a body piercing instrument is disclosed, the holder comprising first and second jaw portions integrally formed with legs commonly attached at distal ends of the first and second jaw portions, a first recess disposed at a proximal end of the first jaw portion for engaging plunger mechanism of the piercing instrument, a second recess disposed at a proximal end of the second jaw portion for engaging a locknut support of the piercing instrument and means for retaining the piercing instrument in a fixed positional relationship with the holder when the plunger mechanism is engaged by the first recess and the locknut support is engaged by the second recess. The first and second jaw portions are commonly attached by a resilient bight portion. The retaining means comprises at least one protrusion disposed on an inner surface of the second jaw portion, and may further comprise two opposing protrusions between which the U-shaped member of the piercing instrument is located when the plunger mechanism is engaged by the first recess and the locknut support is engaged by the second recess.

According to another embodiment of the present invention, a combination of a body piercing instrument and a holder for the instrument are disclosed, the body piercing instrument including a plunger adapted to engage a head of a body piercing pin and a locknut support adapted to receive a pointed end of the pin after it has been projected through a body part, the holder comprising means for commonly supporting the plunger engaging means and the locknut support engaging means and means for preventing the piercing instrument from being dislodged from the holder. The plunger engaging means is disposed at a proximal end of a first jaw portion, the locknut support engaging means is disposed at a proximal end of a second jaw portion, and the commonly supporting means comprises a resilient bight integrally formed with a distal end of the first jaw portion and the second jaw portion. The preventing means comprises a number of protrusions arranged on the second jaw portion to retain the piercing instrument in position in the holder. The preventing means further comprises means for retaining a rear portion of the piercing instrument.

The invention facilitates the use of pre-sterilized, disposable body piercing instruments and minimizes the handling of the sterile piercing instruments. The invention also permits a greater force to be concentrated on the piercing pin. The piercing pin and the locknut are automatically aligned by the holder, which allows pressure to be applied to the instrument in exactly the right direction, which is along a longitudinal axis of the plunger. The holder also permits a more secure grip on the instrument and facilitates the use of body piercing instruments by individuals with large hands or limited dexterity.

BRIEF DESCRIPTION OF THE DRAWINGS

The foregoing and other objects and advantages of the invention will be understood more fully from the following detailed description thereof, with reference to the accompanying drawings, wherein.

DETAILED DESCRIPTION OF THE INVENTION

Figure 1:
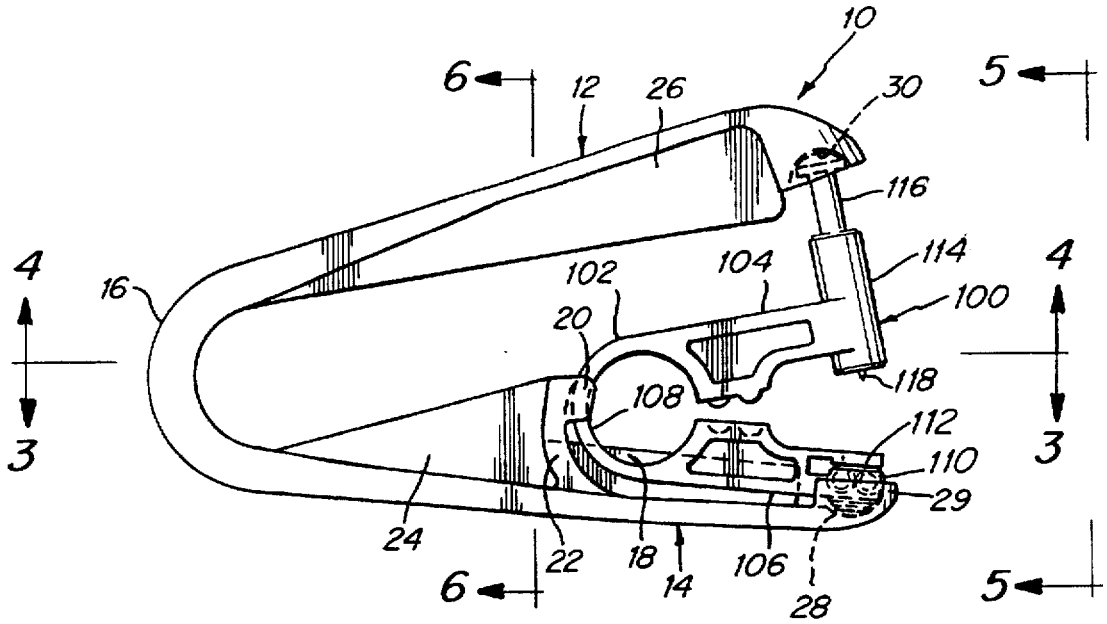
FIG. 1 is a side elevational view of the piercing instrument and the holder of the present invention in an open position.

FIG. 1 shows a holder 10 with piercing instrument 100 installed in accordance with the present invention. Holder 10 includes jaws 12 and 14 interconnected by a flexible integrally formed bight 16. Jaw 14 includes a wall 18 and a protrusion 20 which are formed on opposite sides of the inside surface of jaw 14. Protrusion 20 is disposed at the top of extension 22. Jaw 14 also includes a flange 24 which is centrally located on jaw 14 and which extends from extension 22 to a position close to bight 16. Jaw 12 includes a flange 26 which is centrally located on jaw 12 and extends from just short of the free or forward end of jaw 12 to a position close to the bight 16. Shown in phantom in FIG. 1, jaw 14 includes a recess 28 and retainer 29 and jaw 12 includes a recess 30.

The piercing instrument generally illustrated in FIG. 1 is best illustrated in U.S. Pat. No. 4,164,224. The piercing instrument illustrated in the patent, illustrative of the type of body piercing device for which the invention herein is described and designed, and shown in FIG.1, includes a body portion 102, including a pair of jaws 104 and 106 connected by an integral bight 108. The free end of jaw 106 is provided with locknut support 110 designed to hold a locknut 112 of the type normally used in body piercing systems. The other jaw 104 is provided with means 114 for supporting plunger 116. Plunger 116 engages the head of a piercing pin with a point 118 projecting from means 114. In use, the operator normally places, for example, an earlobe between the point 118 of the pin and the locknut support 110. Piercing instrument 100 is then squeezed by applying pressure to the end of the plunger 116 and the outer surface of locknut support 110. This causes the instrument to compress to the position illustrated in FIG. 2. Upon application of further pressure, the pin is suddenly released to pierce the earlobe and engage the locknut 112. Pressure on piercing instrument 100 is released allowing the jaws 104 and 106 to separate. The piercing instrument is then slid from engagement with the now inter-engaged pin and locknut.

Holder 10 is formed such that, when the holder is in its relaxed state, the distance between jaws 12 and 14 is slightly less than the distance between locknut support 110 and the end of plunger 116 of piercing instrument 100. Therefore, when piercing instrument 100 is installed into holder 10, jaws 104 and 106 are compressed slightly by holder 10, which results in piercing instrument 100 being held, under slight compression, between jaws 12 and 14. The compressive force, however, is not great enough to cause the plunger 116 of piercing instrument 100 to release.

Figure 2:
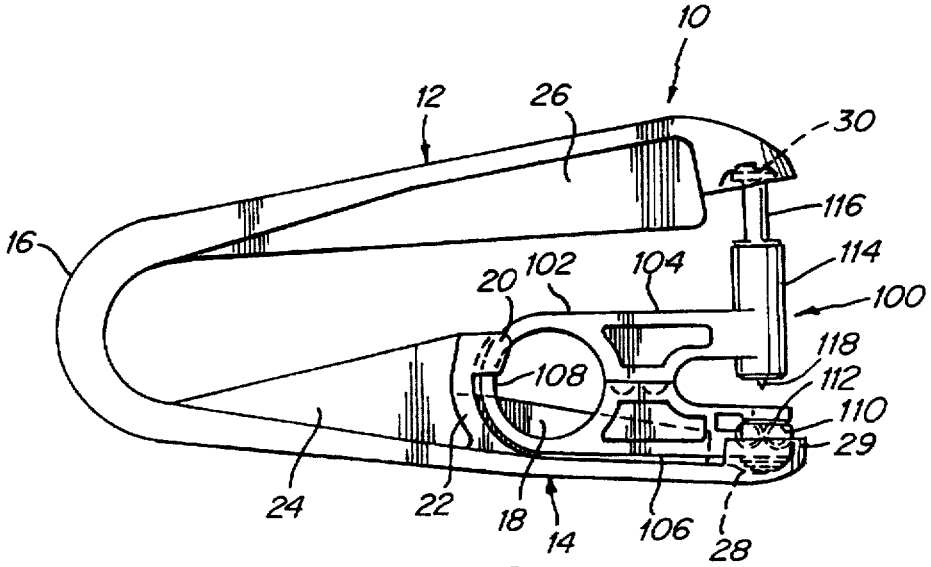
FIG. 2 is a side elevational view of the piercing instrument and the holder of the present invention in a closed position.

FIG. 1 shows holder 10 with piercing instrument 100 installed and in an open position. FIG. 2 shows holder 10 and piercing instrument 100 in a closed position.

Figure 3:
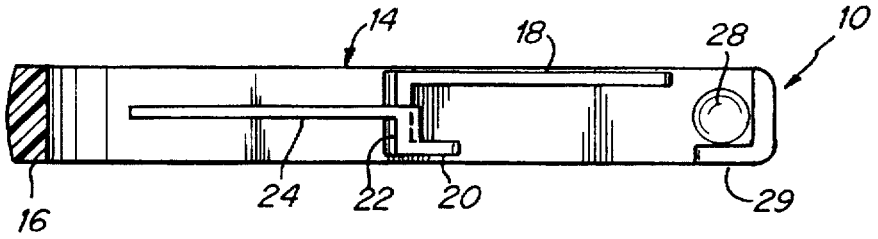
FIG. 3 is a sectional illustration of the lower jaw as seen along the line 3—3 of FIG. 1.
Figure 4:
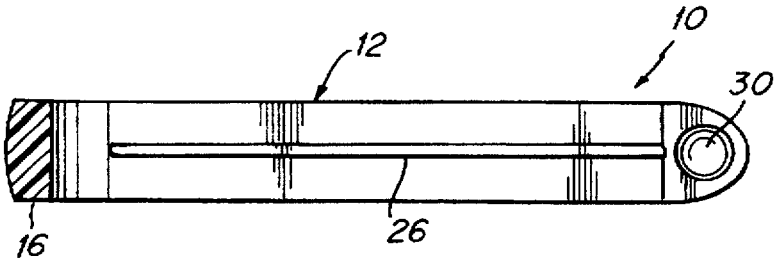
FIG. 4 is a sectional illustration of the upper jaw as seen along the line 4—4 of FIG. 1.

FIG. 3, which is a sectional illustration of jaw 14 along lines 3—3 of FIG. 1, shows recess 28 and retainer 29 formed at the free end of jaw 14. Also shown in FIG. 3 is the relationship between wall 18 and protrusion 20 and the location of flange 24. FIG. 4, which is a sectional illustration of jaw 12 taken along lines 4—4 of FIG. 1, shows recess 30 formed at the free end of jaw 12 and the location of flange 26.

Figure 5:
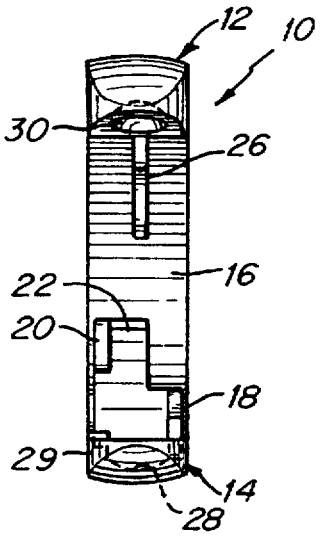
FIG. 5 is an end elevational view of the holder in an open position with the piercing instrument removed, as seen along line 5—5 of FIG. 1.
Figure 6:
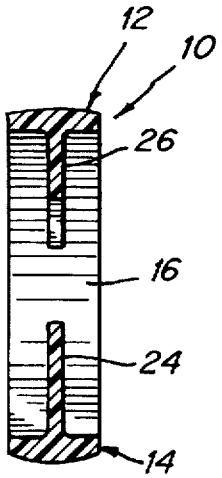
FIG. 6 is a sectional illustration of the holder taken along line 6—6 of FIG. 1.

FIG. 5 is an elevational view of holder 10 in an open position taken along line 5—5 of FIG. 1. FIG. 5 shows that wall 18 and protrusion 20 are located on opposite sides of the inner surface of jaw 14, spaced apart enough to allow body portion 102 of piercing instrument 100 to be positioned between wall 18 and protrusion 20 when the piercing instrument is installed in holder 10. FIG. 6 is a sectional illustration of holder 10 taken along lines 6—6 of FIG. 1, showing the location of flanges 24 and 26 on the inner surfaces of jaws 14 and 12, respectively.

Figure 7:
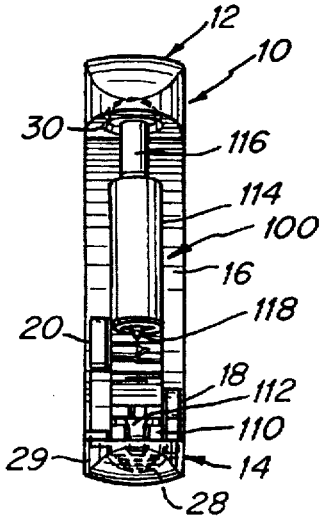
FIG. 7 is an elevational view of the holder with the piercing instrument installed, as seen along line 5—5 of FIG. 2.

FIG. 7 is an elevation view of the holder 10 with piercing instrument 100 installed, as seen along line 5—5 of FIG. 1. As is shown in FIGS. 1 and 7 in combination, when piercing instrument 100 is installed in holder 10, body portion 102 of piercing instrument 100 is positioned between wall 18 and protrusion 20. In this position, piercing instrument 100 is held in coplanar alignment with holder 10, and is prevented from swiveling relative to holder 10.

Holder 10 is made of a suitable plastic that will permit flexing of the holder along bight 16 so as to move the holder from the position shown in FIG. 1 to the position shown in FIG. 2 under hand pressure. The plastic selected should be resilient. Suitable polystyrene or polyethylene plastics may be used.

In the present invention, piercing instrument 100 is positioned under slight compression between jaws 12 and 14 of the holder 10 with the free end of plunger 116 engaged in recess 30 of jaw 12 and locknut support 110 engaged in recess 28 of jaw 14. In this arrangement, piercing instrument 100 and holder 10 assume the position generally illustrated in FIG. 1. In this position, piercing instrument 100 is retained by holder 10 by at least six contact points. The entire inner surface of wall 18 engages one side of jaw 106 of piercing instrument 100, protrusion 20 engages the side of bight 108 which is opposite the side of jaw 106 engaged by wall 18, extension 22 engages the back end of bight 108, recess 28 and retainer 29 engage locknut support 110 and recess 30 engages plunger 116. Wall 18, protrusion 20, extension 22, recess 28, retainer 29 and recess 30 thereby securely retain piercing instrument 100 in all three dimensions, so that it cannot be accidentally dislodged from holder 10 prior to use, such as during packaging, sterilizing or shipping. This arrangement also allows holder 10 to be carried in any position while insuring that piercing instrument 100 will remain in coplanar alignment with holder 10.

The application of about 1½ pounds of force closes the holder and instrument to the position shown in FIG. 2. Increasing the force to about ten pounds results in the sudden release of the pin from its initial position in piercing instrument 100. The point 118 of the pin then pierces the earlobe and engages the locknut 112. Removal of the force from holder 10 allows the jaws 12 and 14 of holder 10 to return to their original position. But, since the plunger 116 of piercing instrument 100 remains depressed in the piercing instrument, the overall distance between the outer extremities of jaw 12 and plunger 116 is shorter than the distance between the ends of jaws 12 and 14. Thus, the holder is automatically disengaged from the instrument.

Figure 8:
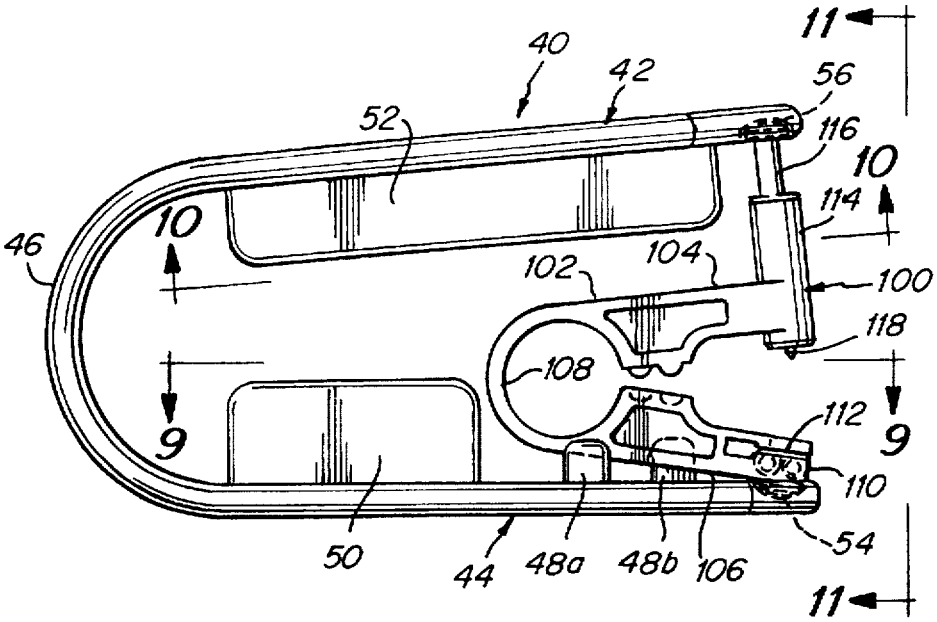
FIG. 8 is a side elevational view of the piercing instrument installed in a second embodiment of the holder of the present invention.
Figure 9:
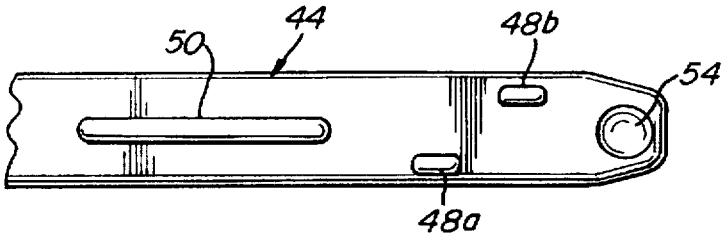
FIG. 9 is a sectional illustration of the lower jaw of the second embodiment of the present invention, taken along line 9—9 of FIG. 8.
Figure 10:
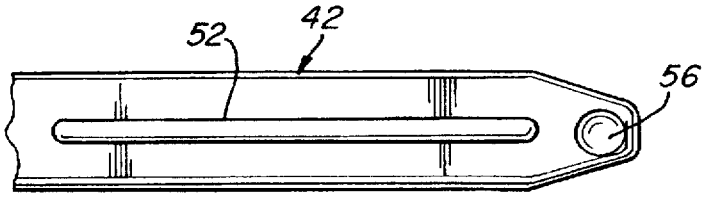
FIG. 10 is a sectional illustration of the upper jaw of the second embodiment of the present invention, taken along line 10—10 of FIG. 8.

A second embodiment of the present invention is shown in FIGS. 8–12. As is shown in FIG. 8, holder 40 includes jaw 42 and jaw 44 interconnected by a flexible integrally formed bight 46. Jaw 44 includes protrusions 48*a* and 48*b* (protrusion 48*b* being shown partially in phantom) located on opposite sides of an inner surface of jaw 44 as is shown in FIG. 9, which is a sectional illustration of jaw 44 taken along lines 9—9 of FIG. 8. FIG. 10 is a sectional illustration of jaw 42 taken along lines 10—10 of FIG. 8.

Holder 40 also includes flange 50, centrally disposed on the inner surface of jaw 44, flange 52, centrally disposed along an inner surface of jaw 42, recess 54, located in the inner surface of the free end of jaw 44 and recess 56, located on the inner surface of the free end of jaw 42. Recesses 54 and 56 are adapted to receive locknut support 110 and plunger 116 of piercing instrument 100, respectively.

Figure 11:
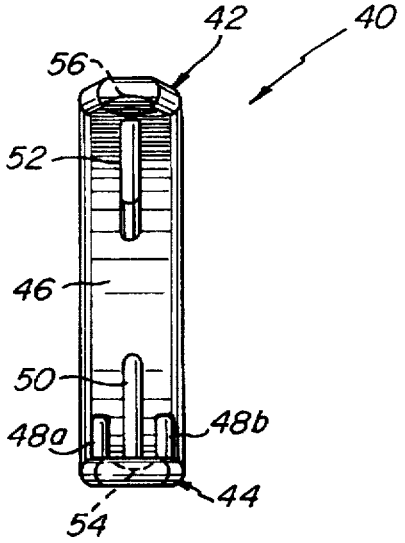
FIG. 11 is an end elevational view of the second embodiment of the holder of the present invention with the piercing instrument removed, as seen along line 11—11 of FIG. 8.

FIG. 11 is an elevational view of holder 40 taken along lines 11—11 of FIG. 9, showing the relative positions of the elements of holder 40, particularly jaws 42 and 44, bight 46, protrusions 48*a* and 48*b* and flanges 50 and 52.

Figure 12:
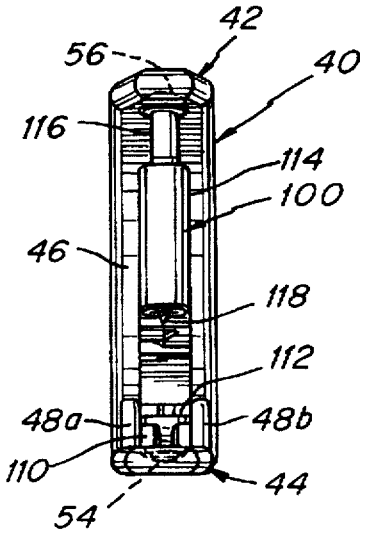
FIG. 12 is an end elevational view of the second embodiment of the holder with the piercing instrument installed, as seen along line 11—11 of FIG. 8.

When piercing instrument 100 is inserted into holder 40, the body portion 102 of piercing instrument 100 is positioned between protrusions 48*a* and 48*b*, as shown in FIGS. 8 and 12, FIG. 12 being an elevational view of holder 40 with the piercing instrument installed, taken along line 11—11 of FIG. 8. Protrusions 48*a* and 48*b* engage each side of piercing instrument 100, flange 50 engages the back end of bight 108 of piercing instrument 100, recess 54 engages locknut support 110 and recess 56 engages plunger 116. This engagement by several contact points in all three dimensions retains piercing instrument 100 in holder 40, preventing it from being dislodged from holder 40 prior to use, and from swiveling out of coplanar alignment with holder 40.

Once piercing instrument 100 is inserted into holder 40 as described above and illustrated in FIG. 8, the operation of the holder 40 is identical to that of holder 10, described above with reference to FIGS. 1–7.

The size of the holder may vary, depending upon the specific type of piercing instrument used. However, in a preferred embodiment, the holder should be sized with jaws sufficiently long to fit comfortably in one's hand. Furthermore, while the example described in the disclosure is directed to a holder for an earlobe piercing instrument, the disclosed instrument and holder are not limited to piercing earlobes, and may be used to piercing any piercable body part.

Having thus described at least one illustrative embodiment of the invention, various alterations, modifications, and improvements will readily occur to those skilled in the art. Such alterations, modifications, and improvements are intended to be within the spirit and scope of the invention. Accordingly, the foregoing description is by way of example only and is not intended as limiting. The invention is limited only as defined in the following claims and the equivalents thereto.

What is claimed is:

1. In combination, a piercing instrument and a holder for said piercing instrument, said piercing instrument including a plunger adapted to engage a head of a piercing pin and a locknut support adapted to receive a pointed end of said piercing pin after it has been projected through a body part, said holder comprising means for commonly supporting said plunger engaging means and said locknut support engaging means and means for preventing said piercing instrument from being dislodged from said holder.

2. The combination of claim 1, wherein said plunger engaging means is disposed at a proximal end of a first jaw portion of said holder, said locknut support engaging means is disposed at a proximal end of a second jaw portion of said holder, and wherein said commonly supporting means comprise a resilient bight integrally formed with a distal end of said first jaw portion and said second jaw portion.

3. The combination of claim 2, wherein said preventing means comprises a number of protrusions arranged on said second jaw portion to retain said piercing instrument in position in said holder.

4. The combination of claim 3, wherein said preventing means comprises two opposing protrusions, one located on each side of said piercing instrument when said holder is holding said piercing instrument.

5. The combination of claim 4, wherein said preventing means further comprises means, arranged on said second jaw portion, for retaining a rear portion of said piercing instrument.

* * * * *